US006741208B1

(12) United States Patent
West et al.

(10) Patent No.: US 6,741,208 B1
(45) Date of Patent: May 25, 2004

(54) DUAL-MODE SWITCHED APERTURE/ WEATHER RADAR ANTENNA ARRAY FEED

(75) Inventors: James B. West, Cedar Rapids, IA (US); Kenneth R. Stinson, Robins, IA (US)

(73) Assignee: Rockwell Collins, Cedar Rapids, IA (US)

( * ) Notice: Subject to any disclaimer, the term of this patent is extended or adjusted under 35 U.S.C. 154(b) by 0 days.

(21) Appl. No.: 10/430,531

(22) Filed: May 6, 2003

(51) Int. Cl.[7] ..... H01Q 3/02; H01Q 3/12
(52) U.S. Cl. ..... 342/374; 342/155; 343/876
(58) Field of Search ..... 342/374, 155; 343/876

(56) References Cited

U.S. PATENT DOCUMENTS 4,123,759 A * 10/1978 Hines et al. ..... 343/876
5,198,828 A 3/1993 West et al.
6,388,607 B1 5/2002 Woodell
6,606,057 B2 * 8/2003 Chiang et al. ..... 342/374

* cited by examiner

*Primary Examiner*—Theodore M. Blum
(74) *Attorney, Agent, or Firm*—Nathan O. Jensen; Kyle Eppele

(57) ABSTRACT

A weather radar antenna for radiating a desired beam formed by feeding quadrants of the antenna uses a dual-mode switched aperture antenna feed. The dual-mode switched antenna feed has an input divider that splits the input signal. A left switch switches the split input signal using a left first diode and a left second diode to top left and bottom right quadrants of the antenna. A right switch switches the split input signal using a right first diode and a right second diode to top right and bottom left quadrants of the antenna. The diodes are forward and reverse biased as required to feed top, bottom, left and right portions of the antenna to obtain the desired beam. When all the diodes are reversed biased the split signal is fed to all quadrants of the antenna.

20 Claims, 7 Drawing Sheets

DUAL-MODE SWITCHED APERTURE/ WEATHER RADAR ANTENNA ARRAY FEED

BACKGROUND OF THE INVENTION

This invention relates to antennas, weather radar antennas, and specifically to dual-mode switched aperture array antenna.

A weather radar antenna typically comprises a two dimensional array of radiating elements such as linear waveguides as shown in U.S. Pat. No. 5,198,828 incorporated herein by reference. A typical weather radar antenna provides a pencil or sum beam that is scanned either by physically rotating the antenna or by using phased array techniques known in the art. To form the antenna beam, the entire antenna is fed with a radar signal.

Multi-mode weather radars are being developed and utilized for such applications as obstacle detection, non-operative collision avoidance, controlled flight into terrain (CFIT) avoidance, and terrain imaging and mapping at weather radar frequencies. These multi-mode weather radars require increased resolution to detect obstacles and for imaging. A typical 28-inch diameter weather radar antenna has a 3.5° physical 3-dB beam width. Targets cannot be differentiated within the 3-dB beam width. Beam sharpening of the normal weather radar antenna beam is required to further increase resolution for obstade detection.

A military APG-241 radar has been developed that utilizes sub-beam width ground mapping using multi-channel algorithms. This radar is a multi-channel $\Sigma/\Delta$ monopulse radar. Extensive use of microwave hardware is utilized to develop the needed beam width of the antenna that has resulted in an expensive solution for commercial applications.

An effective beam sharpening factor of seven in one dimension has been previously demonstrated on a previous NASA Task 14 radar contract (contract number NAS1-19704). However an antenna feed network utilized in this approach provided excessive Insertion loss that severely limited the radar range at which beam sharpening was accomplished for single axis sharpening. The Task 14 approach is impractical for two-axis sharpening.

Increased resolution of a weather radar system for obstacle detection has been realized by a switched aperture algorithm. The switched aperture algorithm is a hybrid of sequential lobing and phased-based monopulse. Sub-beam width target features manifest themselves as changes in phase after Doppler shifts are processed out of the radar returns. Using the switched aperture algorithm, a factor of seven effective beam width reduction has been demonstrated under the NASA Task 14 contract previously mentioned. In order to demonstrate the switched aperture algorithm, an implementation under the NASA contract used commercial of the shelf (COTS) single pole double throw (SPDT) X-band microwave switches. The proof-of-concept demo was for a single axis implementation. Using the COTS switches resulted in marginal range of the radar due to sever insertion losses. The COTS switches also had power handling concerns. Implementation of a two-axis switched aperture is not practical using COTS switches due to insertion losses.

What is needed is a high performance, low-loss, dual-mode, simple and practical antenna feed switching network design for a switched aperture beam sharpening algorithm that also may be used as a sum beam for conventional weather detection.

SUMMARY OF THE INVENTION

An antenna having a dual-mode switched aperture antenna feed for feeding an input signal to selected portions of the antenna to form a desired beam is disclosed. The antenna feed comprises an input divider for receiving the input signal and splitting the input signal. A left switch receives the split input signal and switches the split input signal to selected portions of the antenna. The left switch further comprises a left first diode and a left second diode for switching the split input signal. A right switch receives the split input signal and switches the split input signal to selected portions of the antenna. The right switch further comprises a right first diode and a right second diode for switching the split input signal.

In the left switch when the first diode is reversed biased and the second diode is forwarded biased the left switch is a waveguide elbow from an input port to a first output port and the signal is applied to a first portion the antenna. When the first diode is forward biased and the second diode is reverse biased the left switch is a waveguide elbow from the input port to a second output port and the signal is applied to a second portion of the antenna.

In the right switch when the right first diode is reversed biased and the right second diode is forwarded biased the right switch is a waveguide elbow from an input port to first output port and the signal is applied to a third portion of the antenna. When the right second diode is reversed biased and right first diode is forwarded biased the right switch is a waveguide elbow from the input port to a second output port and the signal is applied to a fourth portion of the antenna.

A desired beam of the antenna is formed by feeding the split input signal to a top portion of the antenna by reverse biasing the left first diode and forward biasing the left second diode to feed the split input signal to a top left (TL) quadrant of the antenna and by forward biasing the right first diode and reverse biasing the right second diode to feed the split input signal to a top right (TR) quadrant of the antenna.

A desired beam of the antenna is formed by feeding the split input signal to a bottom portion of the antenna by forward biasing the left first diode and reverse biasing the left second diode to feed the split input signal to a bottom right (BR) quadrant of the antenna and by reverse biasing the right first diode and forward biasing the right second diode to feed the split input signal to a bottom left (BL) quadrant of the antenna.

A desired beam of the antenna is formed by feeding the split input signal to a left portion of the antenna by reverse biasing the left first diode and forward biasing the left second diode to feed the split input signal to a TL quadrant of the antenna and by reverse biasing the right first diode and forward biasing the right second diode to feed the split input signal to the BL quadrant of the antenna.

A desired beam of the antenna is formed by feeding the split input signal to a right portion of the antenna by forward biasing the left first diode and reverse biasing the left second diode to feed the split input signal to the BR quadrant of the antenna and by forward biasing the right first diode and reverse biasing the right second diode to feed the split input signal to the TR quadrant of the antenna.

A desired beam of the antenna is formed by feeding all portions of the antenna by reverse biasing the left first diode, the left second diode, the right first diode, and the right second diode to feed the split signals to the TL, TR, BL, and BR quadrants of said antenna.

It is an object of the present invention to provide a high-performance dual-mode simple and practical antenna feed switching network design for a switched aperture beam sharpening algorithm that also may be used as a sum beam for conventional weather detection.

It is an object of the present invention to provide a two-axis switching network with reduced losses.

It is an advantage of the present invention to provide a dual-mode antenna feed switching network that uses low-cost waveguide components.

It is an advantage of the present invention to provide a switching network that is lighter than previous networks.

It is a feature of the present invention to provide a dual-mode switched aperture antenna for aircraft applications that can be used for weather radar, collision avoidance, object mapping and imaging purposes.

It is a feature of the present invention to provide a dual-mode switched aperture antenna for next generation multimode weather radar system applications.

BRIEF DESCRIPTION OF THE DRAWINGS

The invention may be more fully understood by reading the following description of the preferred embodiments of the invention in conjunction with the appended drawings wherein.

DETAILED DESCRIPTION

The present invention is for an antenna feed architecture that provides a two-axis dual-mode switchable antenna for obstacle detection and imaging along with a pencil (sum) beam for weather radar operation. Dual mode indicates that the antenna is used for nornmal weather radar operation and for other purposes such as obstacle detection and imaging.

Figure 1:
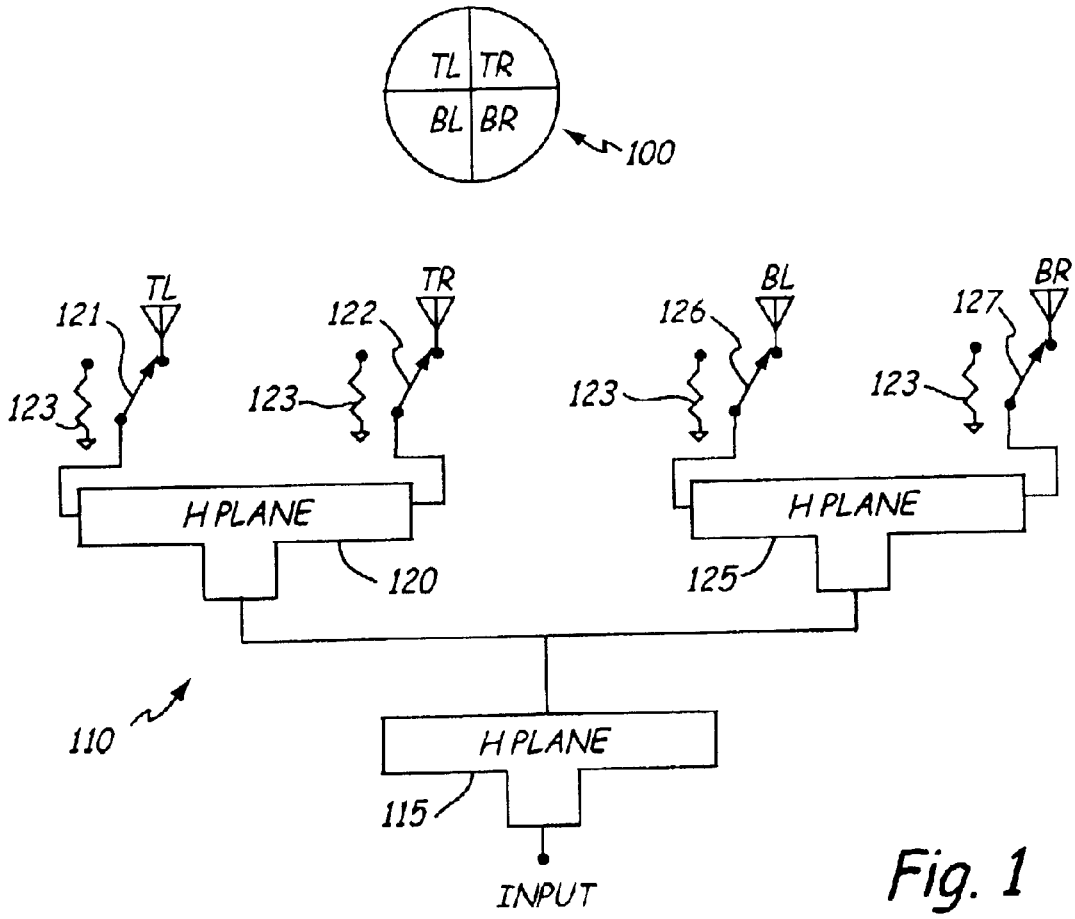
FIG. 1 is a diagram of a switched aperture antenna switching network that feeds a weather radar antenna with high losses.

A weather radar antenna 100 fed with a two-dimensional implementation of a switched aperture antenna switching network 110 as based on a one-dimensional implementation that was previously used with a beam sharpening algorithm on the NASA contract is shown in FIG. 1. The antenna 100 is a quadrant feed slotted waveguide array. The antenna 100 is divided into four quadrants each fed by the switching network 110. The beam sharpening in elevation is accomplished by rapid switching of an X-band radar signal between a top half of the antenna 100 and a bottom half of the antenna 100, i.e. switching between a top left/top right (TL/TR) quadrant combination and the bottom left/bottom right (BL/BR) quadrant combination. Similarly, azimuth beam sharpening is accomplished by rapid switching of the radar signal between a left half of the antenna 100 and a right half of the antenna 100, i.e. switching between a top left/bottom left (TL/BL) quadrant combination and a top right/bottom right (TR/BR) quadrant combination.

The antenna feed network 110 must provide a low-loss X Band signal path for the radar signal for both elevation and azimuth switching operations. In addition, the antenna feed network 110 must have a low-loss in-phase signal path to generate a pencil (sum) beam for conventional weather and wind shear detection.

A simple implementation of the dual-mode switched aperture/weather radar pencil beam antenna switching network 110 is illustrated schematically in FIG. 1. In FIG. 1, the X-band radar signal is input to an H-plane in-phase waveguide splitter 115. The first waveguide splitter 115 splits the radar signal and provides split signals to a second waveguide splitter 120 and a third waveguide splitter 125. The second waveguide 120 splitter splits the radar signal it receives and provides the split signal to a first single pole double throw (SPDT) waveguide switch 121 and a second SPDT switch 122. The first switch 121 switches between a termination load 123 and the TL quadrant of the antenna 100. The second switch 122 switches between another termination load 123 and the TR quadrant of the antenna 100. The third waveguide splitter 125 splits the signal it receives and provides the split signal to a third SPDT waveguide switch 126. The third switch 126 switches between termination load 123 and the BL quadrant of antenna 100. The third splitter 125 also provides the split signal to a fourth switch 127. The fourth switch 127 switches between termination load 123 and the BR quadrant of the antenna 100. Using switches 121, 122, 126, and 127, the radar beam can be shaped as described above by switching between top/bottom and right/left quadrant combinations of the antenna 100 to form the desired beam. When in the normal weather radar mode, all switches 121, 122, 126, and 127 are connected to all antenna quadrants TL, TR, BL, and BR of the antenna 100.

The switching scheme 110 shown in FIG. 1 has several limitations. There is a 3.0-dB one-way insertion loss (ignoring switch loss) with the switched aperture mode of operation because the unused splitter (120 and 125) outputs are terminated in loads 123. This results in a 6.0-dB loop loss in the radar system, which is impractical. This loss can only be made up with increased antenna aperture size, which is not possible due to air transport aircraft radome swept volume constraints. Low-loss, high-power two-way waveguide switches are not readily available as commercial off the shelf (COTS) items. It is anticipated that the insertion losses of the switches 121, 122, 126, and 127 will be a further limitation. The insertion loss of COTS switches are on the order of 2.0 to 3.0 dB at X-band for power levels of a typical weather radar system. The one-way radar loop loss including switch losses is then 6.0 dB, (3.0-dB splitter loss+3.0-dB switch loss) with a total two-way radar loop loss of 12.0 dB, which is prohibitively excessive.

Figure 2:
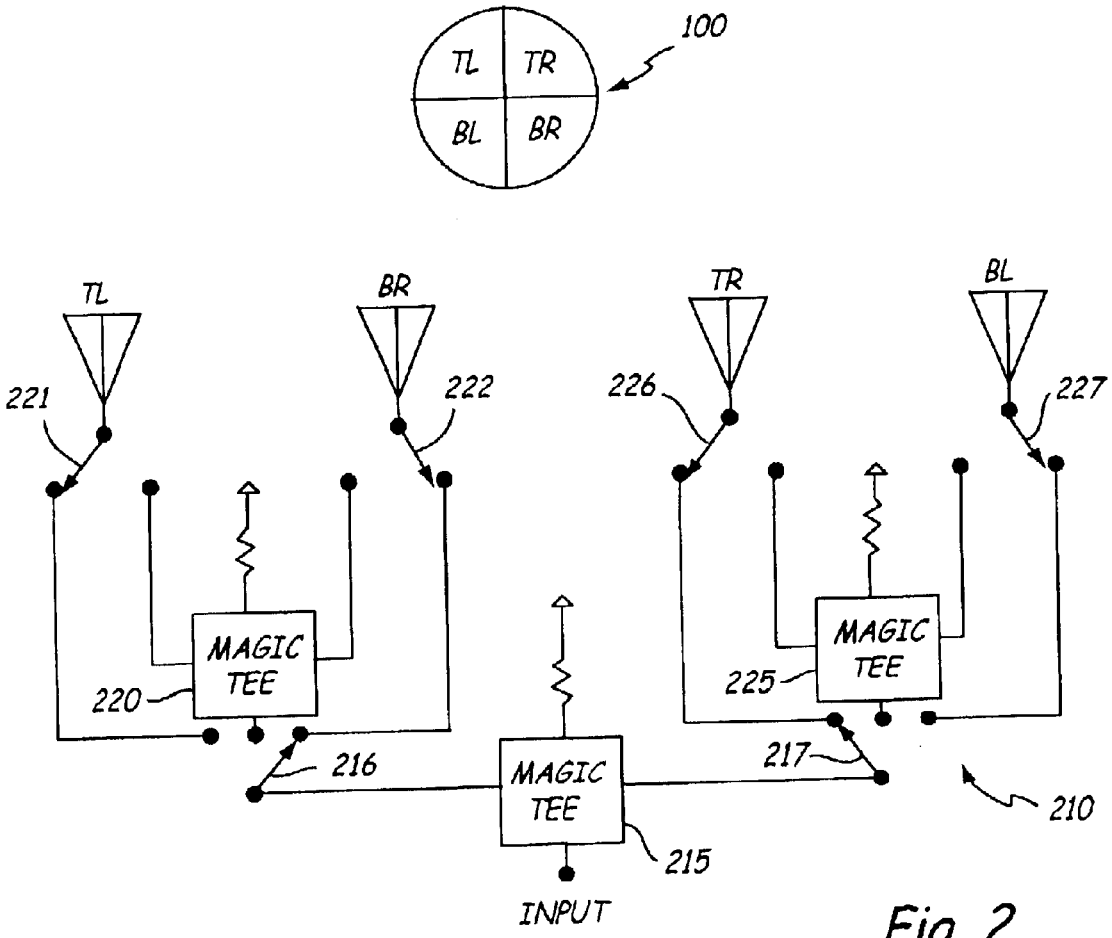
FIG. 2 is a diagram of another switched aperture antenna switching network that reduces losses due to switches.

A second switching scheme 210 that alleviates the 3.0-dB one-way splitter insertion loss problem is shown in FIG. 2. The implementation shown in FIG. 2 utilizes magic tees known in the art. In FIG. 2, the radar signal is fed to a first magic tee 215 where it is split and fed to a first single pole triple throw (SP3T) waveguide switch 216 and a second single pole triple throw waveguide switch 217. The first SP3T switch 216 switches between a first single pole double throw (SPDT) switch 221, a second magic tee 220, and a second SPDT switch 222. The first switch 221 switches the TL quadrant of antenna 100 between the first SP3T switch 216 and a first output of the second magic tee 220. The second SPDT switch 222 switches the BR quadrant of antenna 100 between first SP3T switch 216 and a second output of magic tee 220. The second SP3T switch 217 switches between a third SPDT switch 226, a third magic tee 225, and a fourth SPDT switch 227. The third SPDT switch 226 switches the TR quadrant of antenna 100 between the second SP3T switch 217 and a first output of the third magic tee 225. The fourth SPDT switch 227 switches the BL quadrant of antenna 100 between the second SP3T switch 217 and a second output of the third magic tee 225. As can be seen from FIG. 2 various combinations of the antenna 100 modes can be switched through switches 216, 217, 221, 222, 226, and 227.

The second switching network 210 shown in FIG. 2 also has several disadvantages. There are a large number of microwave waveguide switches (six) that increases the cost of the assembly. Low-loss, high-isolation, high-power single pole triple throw (SP3T) COTS waveguide switches 216 and 217 are not available. The feed network switching scheme 210 is excessively complex and heavy. It is anticipated that the insertion losses of the switches will again be a limitation. The insertion loss of COTS SPDT switches 221, 222, 226, and 227 is on the order of 2.0 to 3.0 dB at X-band for the power levels of interest. The one-way radar path loss is still 4.0 to 6.0 dB for a total 8.0- to 12.0-dB two-way radar loop loss, which is still prohibitively excessive.

Figure 3:
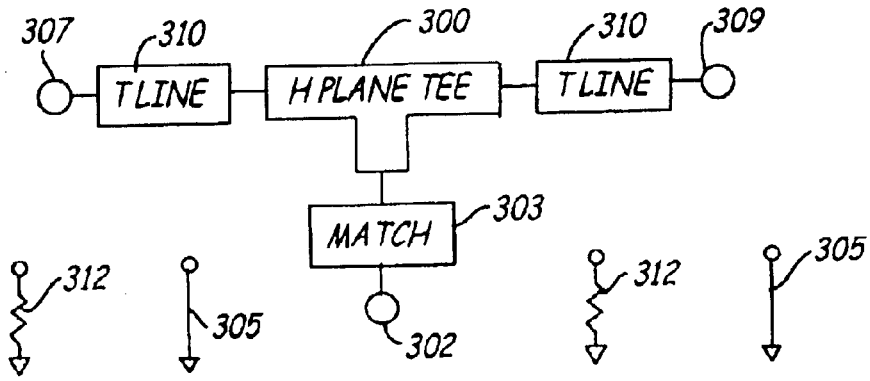
FIG. 3 is a diagram of a dual-mode splitter/elbow implemented with a three-port H-plane waveguide tee that may be used in the present invention.

FIG. 3 illustrates a dual-mode splitter/elbow implemented with a three-port H-plane waveguide tee 300 that may be used in the present invention. The three-port H-plane tee 300, available commercially (without shorts), acts as either an H-plane waveguide power splitter or a two-position waveguide switch (elbow) when used in conjunction with the shorts. When an output port 307 or 309 is connected to an ideal short 305 with a specific length of transmission line 310, an equivalent reactance is realized at an H-plane tee's junction such that the three-port H-plane tee 300 effectively becomes a tuned waveguide elbow from an input port 302 to an output port 307 or 309 opposite of that having the short 305. Since the device is symmetrical and reciprocal, an input 302 to right output 309 and an input 302 to left output 307 waveguide elbow is realized by the judicious placement of shorts 305 on transmission lines 310 of a tuned length. When the shorts 305 are removed from the circuit, the H-plane tee is a traditional three-port, in-phase 3-dB power splitter delivering power to loads 312. A matching network 303 provides any impedance matching that may be needed.

Figure 4:
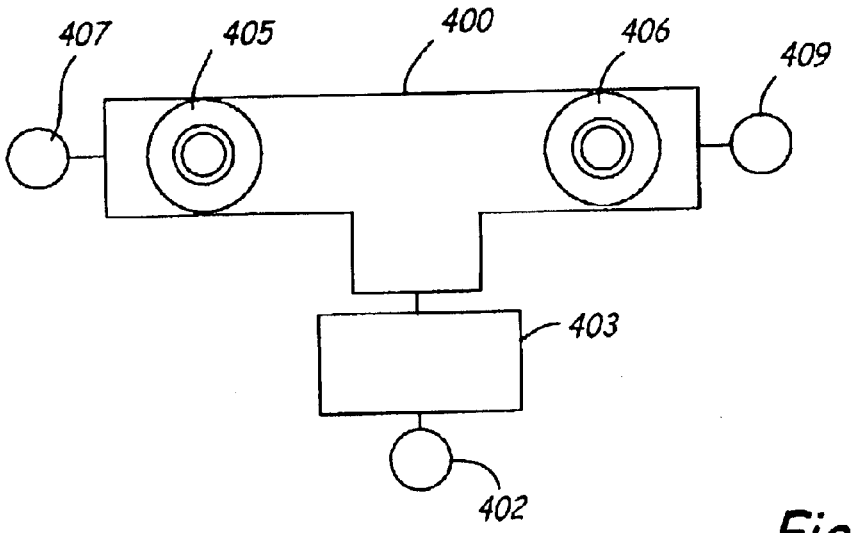
FIG. 4 is a diagram of an alternate embodiment of the dual-mode power splitter/switch of FIG. 3 that utilizes reflective switching diodes.
Figure 4A:
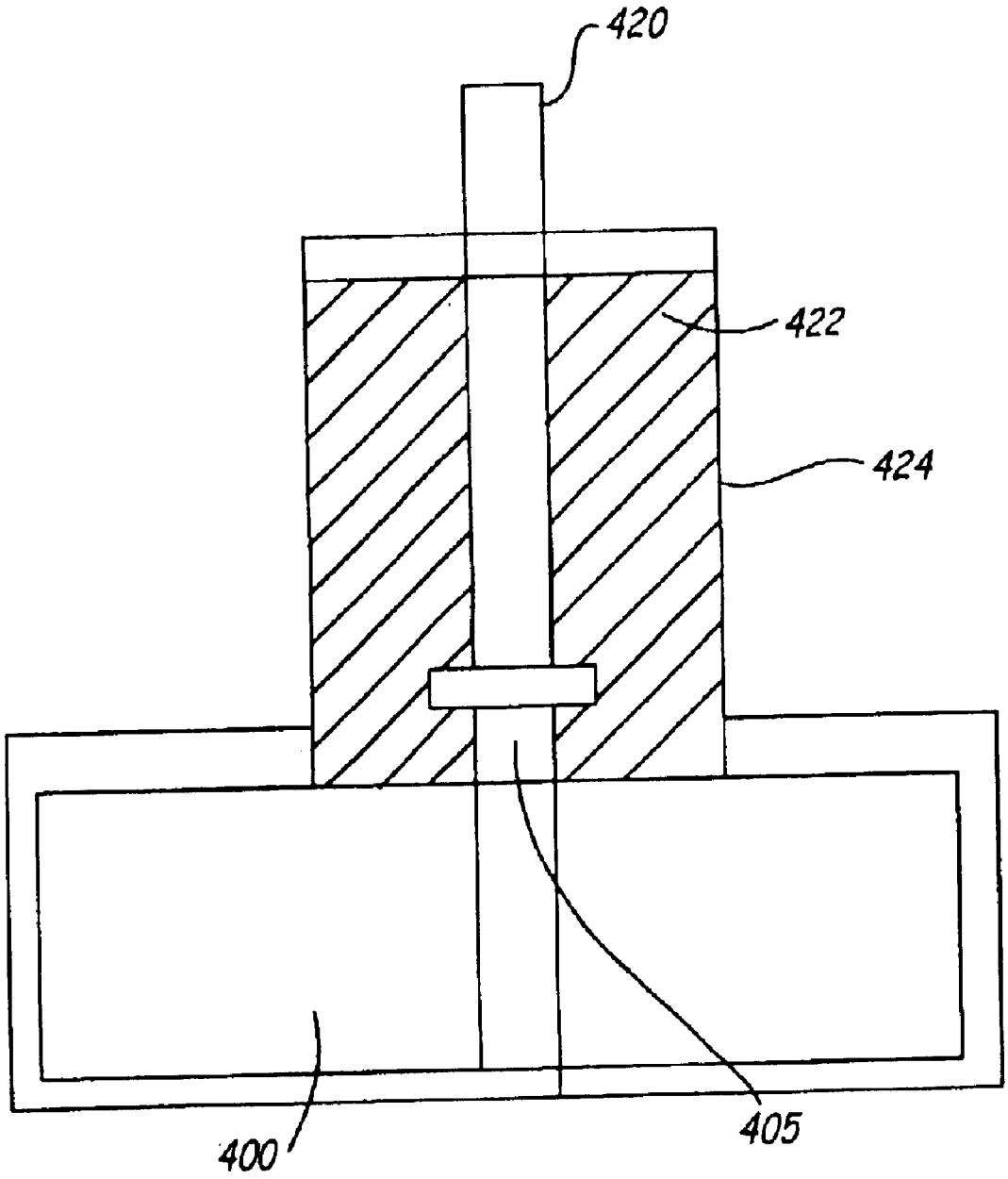
FIG. 4*a* illustrates a coax to waveguide transition used in mounting a reflective switching diode of FIG. 4.

Another embodiment of the three-port H-plane tee 300 of FIG. 3 is shown in FIG. 4. Waveguide PIN diode reflective switches 405 and 406 replace the ideal shorts 305 of FIG. 3. Commercially available PIN diode reflective switch assemblies may be connected to the three-port H-plane tee 300 of FIG. 3. Alternately a three-port H-plane tee 400 may have the waveguide PIN diode reflective switches 405 and 406 mounted on the waveguide using techniques known in the art. FIG. 4*a* illustrates a coax to waveguide transition used in mounting PIN diode reflective switch 405 to tee 400. In FIG. 4*a* a spring-fingered metal post 420 holds down diode 405 and forms a center conductor for the coax. Bias for the PIN diode 405 is applied to the metal post 420. Coax dielectric 422 provides DC isolation from ground for the PIN diode 405 and bias input. Coax outer conductor 424 completes the transition circuit. Distributed waveguide PIN diodes (not shown) may take the place of diodes 405 and 406.

When the first diode 405 near output port two 407 and the second diode 406 near output port three 409 are reversed biased (open circuit), the dual-mode power splitter/switch 400 performs the function of a -3-dB in-phase waveguide power splitter. When the first diode 405 is reversed biased (open circuit) and the second diode 406 is forwarded biased (short circuit), the device 400 acts like a waveguide elbow from input port 402 to output port two 407. Similarly, when the second diode 406 is reversed biased (open) and the first diode 405 is forwarded biased (short circuit), the device 400 acts like a waveguide elbow from input port 402 to output port three 409. The switching function is implemented with reflective waveguide switches 405 and 406 utilizing packaged PIN diode switching semiconductor devices, but distributed PIN semiconductor waveguide windows, or other types of waveguide compatible semiconductor switches, may also be used. A matching network 403 provides any impedance matching that may be needed.

Figure 5:
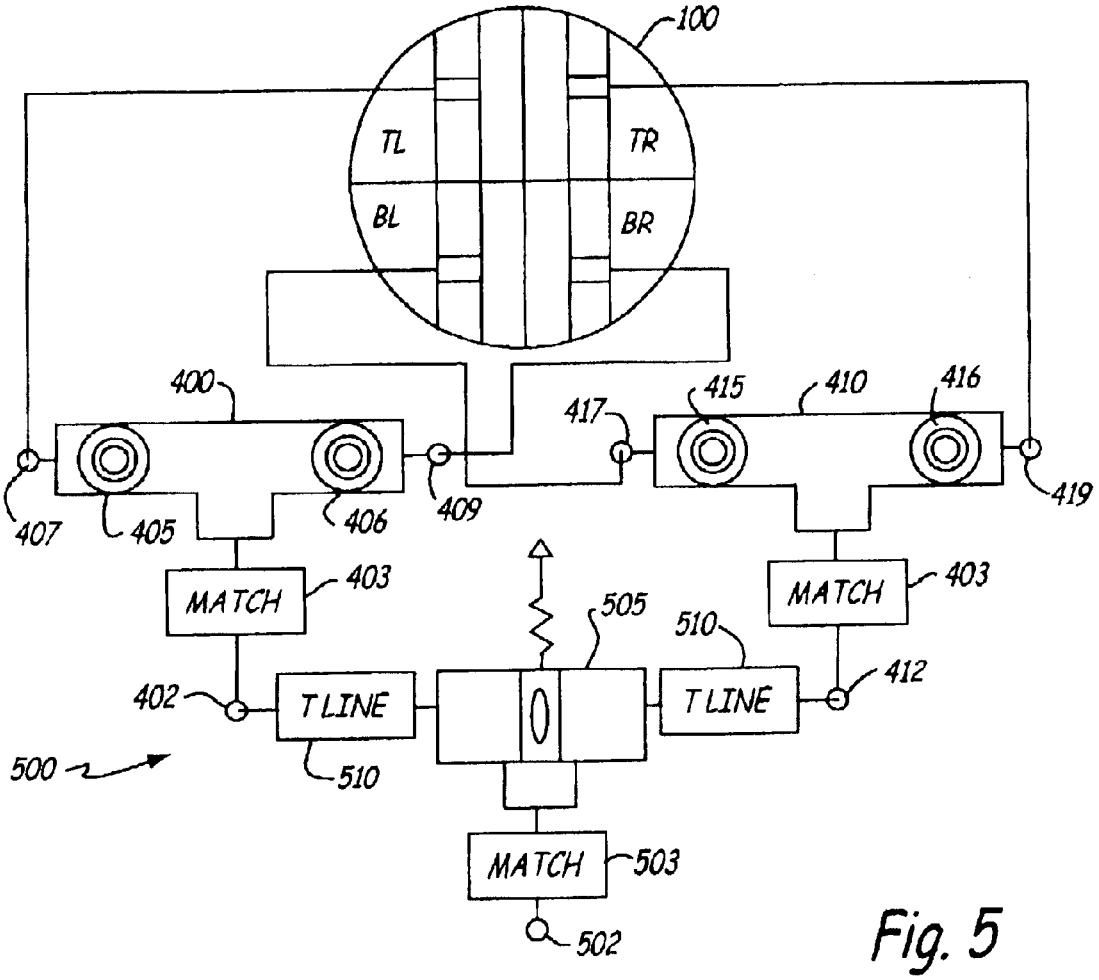
FIG. 5 is a diagram of a two-axis dual-mode switched aperture feed of the present invention.

A two-axis dual-mode switched aperture feed embodiment 500 of the present invention is shown in FIG. 5. In the two-axis switched aperture feed 500, an input waveguide magic tee 505 is used as an input power splitter as described in conjunction with FIG. 2. An H-arm of the magic tee 505 is used as an input port. The input splitter may also be a 90° hybrid, a stacked magic tee, H-plane magic tee, or an E-plane magic tee with the appropriate phase matching from output to output. A radar input signal is applied to an input port 502. If necessary matching network 503 provides an impedance match. The signal is split in the magic tee 505 and sent through transmission lines 510 to a left output port 402 and a right output port 412. The left output port 402 is the input port 402 of the dual-mode power splitter/switch 400 of FIG. 4 serving as a left switch. The left switch 400 has the two diode reflective switches 405 and 406 as in FIG. 4. When the first diode 405 is reversed biased (open circuit) and the second diode 406 is forwarded biased (short circuit), the left switch 400 acts like a waveguide elbow from input port 402 to output port two 407 and the signal is applied to TL quadrant of the antenna 100. Similarly, when diode two 406 is reversed biased (open) and diode one 405 is forwarded biased (short circuit), the left switch 400 acts like a waveguide elbow from input port 402 to output port three 409 and the signal is applied to the BR quadrant of the antenna 100. Biasing of the diodes is performed by a control network (not shown).

The dual-mode switched aperture feed network 500 is described in terms of left and right switches and left/right and top/bottom quadrants of the antenna 100 above and in the following paragraphs. These orientations are chosen for purposes of discussion and illustration of the present invention and other orientations are possible such as top and bottom switches that still are within the scope of the present invention as one of ordinary skill In the art will recognize. Furthermore the invention may be used as a single-axis switch where only the top and bottom portions or only the right and left portions of the antenna are switched.

The right output port 412 is an input port 412 of another dual-mode power splitter/switch 410 serving as a right switch. The right switch 410 has two diode reflective switches 415 and 416 as shown in FIG. 5. When the right first diode 415 is reversed biased (open circuit) and the right second diode 416 is forwarded biased (short circuit), the right switch 410 acts like a waveguide elbow from input port 412 to output port two 417 and the signal is applied to the BL quadrant of the antenna 100. Similarly, when the right second diode 416 is reversed biased (open) and right first diode 415 is forwarded biased (short circuit), the right switch 410 acts like a waveguide elbow from input port 412 to output port three 419 and the signal is applied to the TR quadrant of the antenna 100.

To form a beam using the TL/TR quadrant combination (top portion of antenna 100), left first diode 405 is reverse biased and left second diode 406 is forward biased feeding the signal to the TL quadrant and the right first diode 415 is forward biased and the right second diode is reverse biased feeding the signal to the TR quadrant.

To form a beam using the BI/BR quadrant combination (bottom portion of antenna 100), left first diode 405 is forward biased and left second diode 406 is reversed biased feeding the signal to the BR quadrant and the right first diode 415 is reverse biased and the right second diode 416 Is forward biased feeding the signal to the BL quadrant of the antenna 100.

To form a beam using the TL/BL quadrant combination (left portion of antenna 100), left first diode 405 is reverse biased and left second diode 406 is forward biased feeding the signal to the TL quadrant and the right first diode 415 is reverse biased and the right second diode 416 is forward biased feeding the signal to the BL quadrant of antenna 100.

To form a beam using the TR/BR quadrant combination (right portion of antenna 100), left first diode 405 is forward biased and left second diode 406 is reverse biased feeding the signal to the BR quadrant and the right first diode 415 is forward biased and the right second diode 416 is reverse biased feeding the signal to the TR quadrant of antenna 100.

When all four diodes 405, 406, 415, and 416 are reversed biased in the power splitter mode, the four antenna feed outputs to the TL, TR, BL, and BR quadrants of the antenna 100 are of equal amplitude and phase and a pencil (sum) antenna beam results for normal weather radar operation.

The feed implementation 500 of the present invention shown in FIG. 5 has the following advantages. The feed network 500 is much simpler and lighter weight than of FIG. 2. Weight is an issue since the antenna assembly is mechanically steered with motor drives in azimuth and elevation. The insertion loss performance is far superior to both of the implementations shown in FIGS. 1 and 2. The insertion loss of each switch 400 and 410 is anticipated to be on the order of 0.35 dB, which means the total one way feed network 500 insertion loss would be about 0.7 dB, which includes reactive mismatch and resistive waveguide losses. This is in contrast to the 3.0-dB loss for the implementations of FIGS. 1 and 2. The resultant two-way radar loop loss of FIG. 3 is therefore anticipated to be only about 1.4 dB, which is far superior to the 6.0-dB loss of the previously described switched aperture implementations. The dual-mode waveguide power splitter/switch network 500 is readily realizable in waveguides as shown in FIG. 4*a* and is therefore easily integrated into the feed network assembly.

Circuit simulations of the two-axis beam sharpening system 500 of the present invention have shown excellent results. In the split/split mode or the traditional radar sum beam mode when all four quadrants of the antenna 100 are used an insertion loss of about 0.7 dB worse than a loss-less theoretical value of 6.0 dB is predicted. Two 3-dB losses result from a perfect lossless power split in the split/split mode. In the split/elbow mode with the excitation of one-half of the antenna, for either of the top/bottom or left/right switched aperture modes, the simulation for this mode of operation predicts 0.7 dB of insertion loss worse than a loss-less theoretical value of 3.0 dB. In the split/elbow mode the 3-dB loss results from a perfect one-way power split.

Figure 6A:
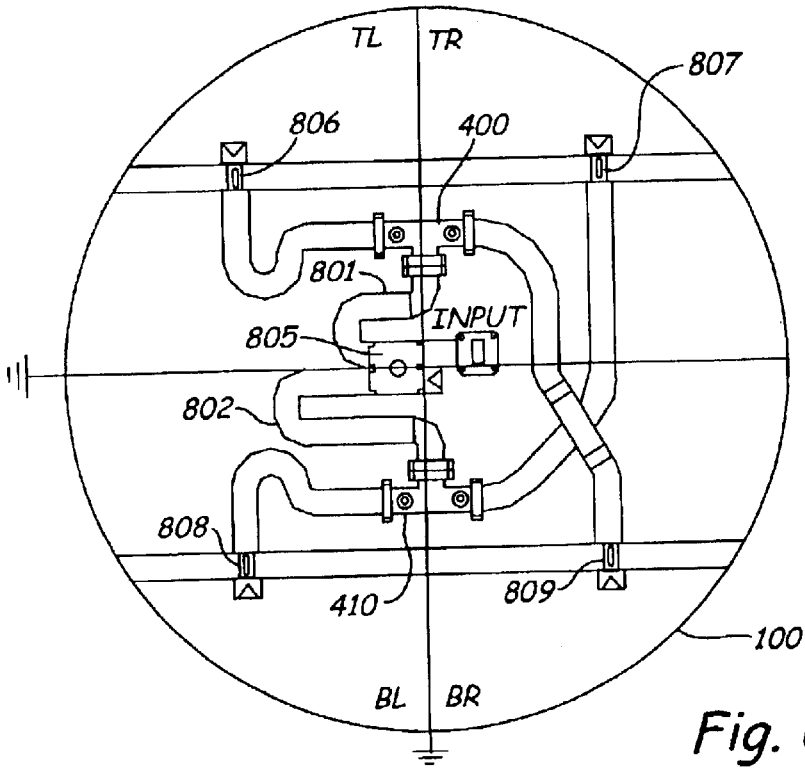
FIG. 6*a* shows a feed manifold implementation with a 90° hybrid input.
Figure 6B:
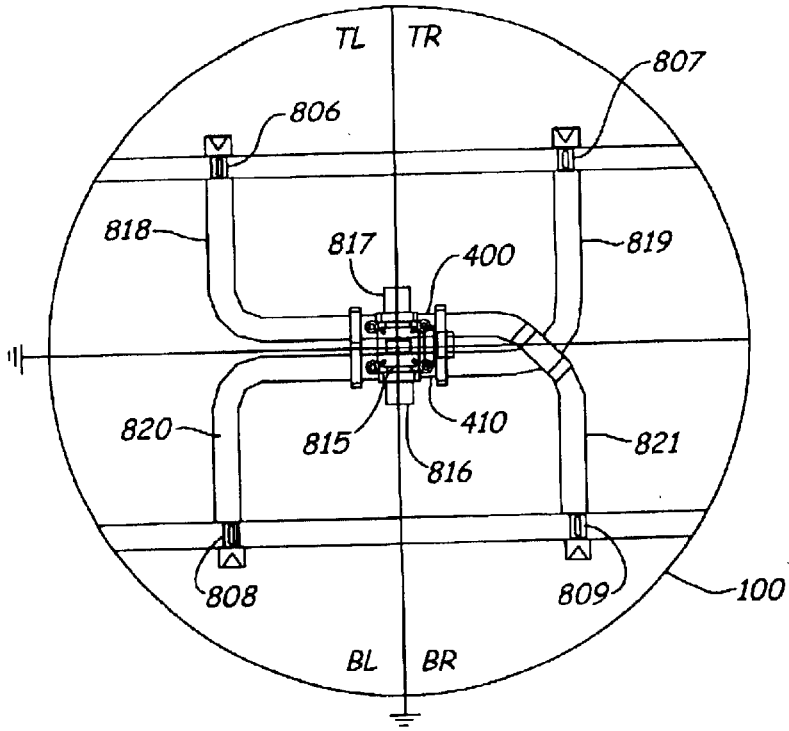
FIG. 6*b* shows a feed manifold implementation with a stacked magic tee input.
Figure 6C:
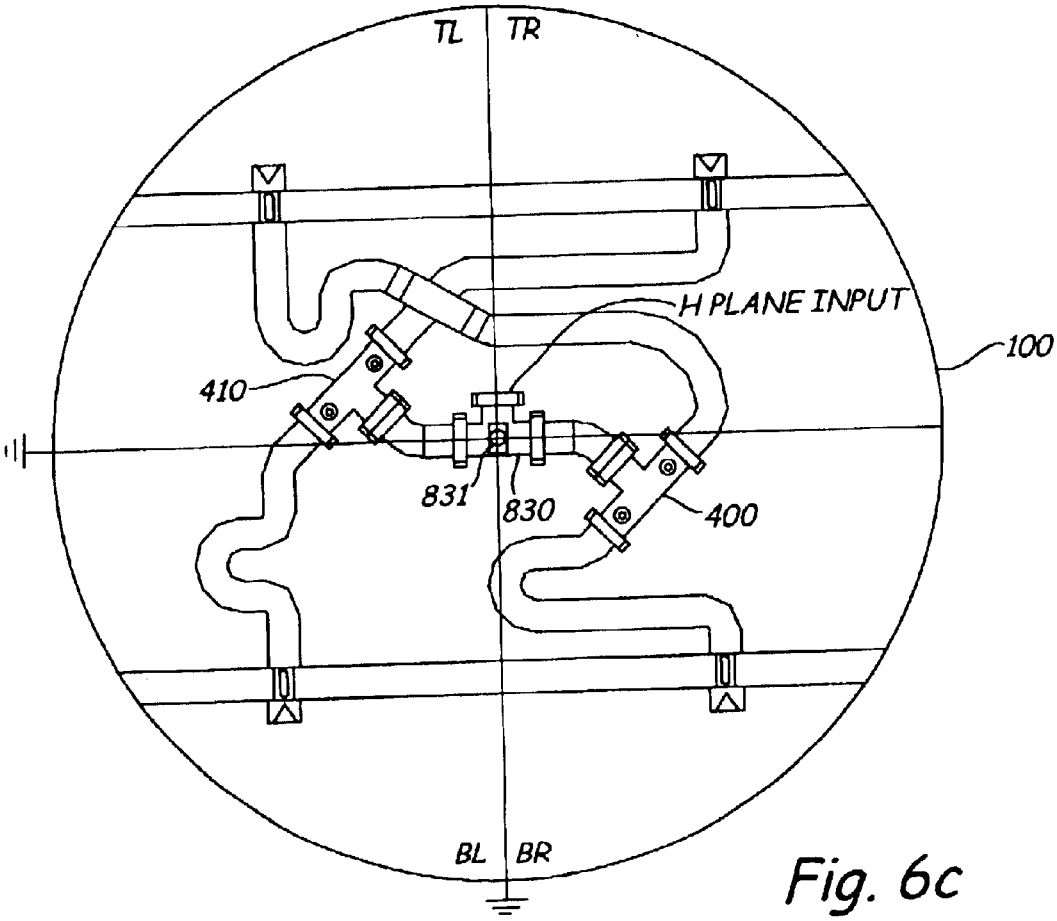
FIG. 6*c* shows a H-arm magic tee input implementation.

FIGS. 6*a*, 6*b*, and 6*c* show antennas 100 with possible feed manifold layouts of the present invention. FIG. 6*a* shows a feed manifold implementation with a waveguide 90° hybrid splitter 805 input. The 90° hybrid splitter, known in the art, provides a 3-dB power split with high port-to-port isolation and a relative phase shift of 90° between the ports. Path lengths 801 and 802 are chosen to offset the 90° phase shift so that the signals at the inputs to switches 400 and 410 are in phase. Feed ports 806, 807, 808, and 809 feed quadrants TL, TR, BL, and BR respectively with waveguides of equal insertion phase.

FIG. 6*b* shows a feed manifold implementation with a stacked magic tee 815 input. The two switches 400 and 410 are placed next to each other as shown. The input magic tee 815 is located on top of the two switches 400 and 410. Two output ports of the magic tee 815 feed input ports of the switches 400 and 410 through 180° E-plane waveguide elbows 816 and 817. The E-plane port of the magic tee 815 is the input. Lengths of output waveguides 818, 819, 820, and 821 from switches 400 and 410 are adjusted for in-phase operation since the magic tee 815 has 180° phase shift on its output driven by its E-plane input. Feed ports 806, 807, 808, and 809 feed quadrants TL, TR, BL, and BR respectively. Alternately the H-plane port of the magic tee 815 can act as an input to the feed manifold with the E-plane of magic tee 815 loaded. This results in a in-phase power split requiring that waveguides 818, 819, 820, and 821 have some insertion phase.

FIG. 6*c* shows an H-arm magic tee 830 input implementation. The two switches 400 and 410 are connected to the H-arm magic tee 830 and to feed ports 806, 807, 808, and 809 with equal insertion phase waveguides to feed quadrants TL, TR, BL, and BR respectively. Load 831 is connected to the E-port of the H-arm magic tee 830.

It is believed that the dual-mode switched aperture weather radar antenna array feed of the present invention and many of its attendant advantages will be understood by the foregoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. An antenna having a dual-mode switched aperture antenna feed for feeding an input signal to selected portions of said antenna to form a desired beam of said antenna said antenna feed comprising:

an input divider for receiving the input signal and splitting the input signal;

a left switch for receiving the split input signal and switching the split input signal to selected portions of the antenna wherein said left switch comprises a waveguide tee with a left first diode and a left second diode coupled to the waveguide for switching the split input signal; and a right switch for receiving the split input signal and switching the split input signal to selected portions of the antenna wherein said right switch comprises a waveguide tee with a right first diode and a right second diode coupled to the waveguide for switching the split input signal.

2. The antenna of claim 1 wherein in the left switch when the left first diode is reversed biased and the left second diode is forwarded biased the left switch is a waveguide elbow from an input port to a first output port and the signal is applied to a first portion the antenna and when said left first diode is forward biased and said left second diode is reverse biased the left switch is a waveguide elbow from the input port to a second output port and the signal is applied to a second portion of the antenna.

3. The antenna of claim 1 wherein in the right switch when the right first diode is reversed biased and the right second diode is forwarded biased the right switch is a waveguide elbow from an input port to first output port and the signal is applied to a third portion of the antenna and when the right first diode is forward biased and right second diode is reverse biased the right switch is a waveguide elbow from the input port to a second output port and the signal is applied to a fourth portion of the antenna.

4. The antenna of claim 1 wherein the desired beam is formed by feeding the split input signal to a top portion of said antenna by reverse biasing said left first diode and forward biasing said left second diode to feed the split input signal to a top left quadrant of said antenna and by forward biasing said right first diode and reverse biasing said right second diode to feed the split input signal to a top right quadrant of said antenna.

5. The antenna of claim 1 wherein the desired beam is formed by feeding a bottom portion of said antenna by forward biasing said left first diode and reverse biasing said left second diode to feed the split input signal to a bottom right quadrant of said antenna and by reverse biasing said right first diode and forward biasing said right second diode to feed the split input signal to a bottom left quadrant of said antenna.

6. The antenna of claim 1 wherein the desired beam is formed by feeding a left portion of said antenna by reverse biasing said left first diode and forward biasing said left second diode to feed the split input signal to a top left quadrant of said antenna and by reverse biasing said right first diode and forward biasing said right second diode to feed the split input signal to the bottom left quadrant of said antenna.

7. The antenna of claim 1 wherein the desired beam is formed by feeding a right portion of said antenna by forward biasing said left first diode and reverse biasing said left second diode to feed the split input signal to the bottom right quadrant of said antenna and by forward biasing said right first diode and reverse biasing said right second diode to feed the split input signal to the top right quadrant of said antenna.

8. The antenna of claim 1 wherein the desired beam is formed by feeding all portions of said antenna by reverse biasing said left first diode, said left second diode, said right first diode, and said right second diode to feed the split signals to the top left, top right, bottom left, and bottom right quadrants of said antenna.

9. The antenna of claim 1 wherein the input divider is one of a magic tee, a stacked magic tee, H-plane magic tee, E-plane magic tee, and a 90° hybrid.

10. An antenna comprising:

an array of radiating elements for radiating a desired beam formed by feeding an input signal to top left, top right, bottom left, and bottom right quadrants of said antenna;

a dual-mode switched aperture antenna feed for feeding the array of radiating elements said dual-mode switched antenna feed comprising:

an input divider for receiving the input signal and splitting the input signal;

a left switch for receiving and switching the split input signal said left switch comprising a waveguide tee with a left first diode and a left second diode for switching the split input signal to the top left and the bottom right quadrants of the antenna; and a right switch for receiving and switching the split input signal said right switch comprising a waveguide tee with a right first diode and a right second diode for switching the split input signal to the top right and the bottom left quadrants of the antenna.

11. The antenna of claim 10 wherein when the left first diode is reversed biased and the left second diode is forwarded biased the split input signal is fed to the top left quadrant and when the left fist diode is forward biased and the left second diode is reverse biased the split input signal is fed to the bottom right quadrant.

12. The antenna of claim 10 wherein when the right first diode is reversed biased and the right second diode is forwarded baised the split input signal is fed to the bottom left quadrant and when the right first is forward biased and right second diode is reverse biased the split input signal is fed to the top right quadrant.

13. The antenna of claim 10 wherein when the left first diode is reversed biased, the left second diode is reverse biased, the right first diode is reverse biased, and the right second diode is reverse biased the split signal is fed to the top left, top right, bottom left and bottom right quadrants of the antenna.

14. The antenna of claim 10 wherein the left switch and the right switch comprise an H-plane waveguide guide tee and the diodes comprise one of PIN diode reflective switch assemblies connected to the H-plane tee, PIN diode reflective switch assemblies mounted to the H-plane tee with a coax to waveguide transition, and distributed waveguide PIN diodes mounted to the H-plane tee with a coax to waveguide transition.

15. A method of feeding an input signal to selected portions of an antenna with a dual-mode switched aperture antenna feed to form a desired beam of said antenna said method comprising the steps of:

splitting the input signal with an input divider;

switching the split input signal to selected portions of the antenna with a left switch comprising a waveguide tee with a left first diode and a left second diode; and switching the split input signal to selected portions of the antenna with a right switch comprising a waveguide tee with right first diode and a right second diode.

16. The method of claim 15 wherein the desired beam is formed by feeding the split input signal to a top portion of said antenna by steps further comprising:

feeding the split input signal to a top left quadrant of said antenna by reverse biasing said left first diode and forward biasing said left second diode; and feeding the split input signal to a top right quadrant of said antenna by forward biasing said right first diode and reverse biasing said right second diode.

17. The method of claim 15 wherein the desired beam is formed by feeding the split input signal to a bottom portion of said antenna by steps further comprising:

feeding the split input signal to a bottom right quadrant of said antenna by forward biasing said left first diode and reverse biasing said left second diode; and feeding the split input signal to a bottom left quadrant of said antenna by reverse biasing said right first diode and forward biasing said right second diode.

18. The method of claim 15 wherein the desired beam is formed by feeding the split input signal to a left portion of said antenna by steps further comprising:

feeding the split input signal to a top left quadrant of said antenna by reverse biasing said left first diode and forward biasing said left second diode; and feeding the split input signal to a bottom left quadrant of said antenna by reverse biasing said right first diode and forward biasing said right second diode.

19. The method of claim 15 wherein the desired beam is formed by feeding the split input signal to a right portion of said antenna by steps further comprising:

feeding the split input signal to a bottom right quadrant of said antenna by forward biasing said left first diode and reverse biasing said left second diode; and feeding the split input signal to a top right quadrant of said antenna by forward biasing said right first diode and reverse biasing said right second diode.

20. The method of claim 15 wherein the desired beam is formed by feeding the split input signal to all portions of said antenna by reverse biasing said left first diode, said left second diode, said right first diode, and said right second diode thereby feeding the split signals to the top left, top right, bottom left, and bottom right quadrants of said antenna.

* * * * *